US007591451B2

(12) United States Patent
Dyer et al.

(10) Patent No.: US 7,591,451 B2
(45) Date of Patent: Sep. 22, 2009

(54) BUNDLE TIE TENSIONING CLUTCH

(75) Inventors: Edward P. Dyer, Germantown, WI (US); William K. Lueschen, Port Washington, WI (US)

(73) Assignee: HellermannTyton Corporation, Milwaukee, WI (US)

( * ) Notice: Subject to any disclaimer, the term of this patent is extended or adjusted under 35 U.S.C. 154(b) by 2 days.

(21) Appl. No.: 11/983,874

(22) Filed: Nov. 13, 2007

(65) Prior Publication Data

US 2009/0121069 A1 May 14, 2009

(51) Int. Cl.
*B21F 9/00* (2006.01)

(52) U.S. Cl. ..... 254/245; 254/252; 254/259; 140/93.2; 140/123.5

(58) Field of Classification Search ..... 254/245, 254/250–252, 259; 140/123.6, 123.5, 93.2
See application file for complete search history.

(56) References Cited

U.S. PATENT DOCUMENTS

| | | | |
|---|---|---|---|
| 2,510,812 | A | 6/1950 | Garland et al. |
| 2,593,789 | A | 4/1952 | Pearson |
| 2,713,279 | A | 7/1955 | Harris |
| 3,130,765 | A | 4/1964 | Neuschotz |
| 3,168,119 | A | 2/1965 | Schwester et al. |
| 3,254,680 | A | 6/1966 | Caveney et al. |
| 3,284,076 | A | 11/1966 | Gibson |
| 3,332,454 | A | 7/1967 | Lawson et al. |
| 3,344,815 | A | 10/1967 | Lawson et al. |
| RE26,492 | E | 11/1968 | Caveney et al. |
| 3,589,406 | A | 6/1971 | Moberg |
| 3,610,296 | A | 10/1971 | Kabel |
| 3,645,302 | A | 2/1972 | Caveney et al. |
| 3,661,187 | A | 5/1972 | Caveney et al. |
| 3,712,346 | A | 1/1973 | Noorily |
| 3,735,784 | A | 5/1973 | Obuch et al. |
| 3,752,199 | A | 8/1973 | Fekete |
| 3,782,426 | A | 1/1974 | Morgan et al. |
| 3,830,263 | A | 8/1974 | Benfer |
| 3,845,554 | A | 11/1974 | Joanis et al. |
| 3,853,155 | A | 12/1974 | Kabel |
| 3,865,156 | A | 2/1975 | Moody et al. |
| 3,931,838 | A | 1/1976 | Bakermans |
| 3,993,109 | A | 11/1976 | Fortsch |
| 4,064,918 | A | 12/1977 | Pubuta et al. |

(Continued)

FOREIGN PATENT DOCUMENTS

| | | | |
|---|---|---|---|
| EP | 1108649 | A2 | 6/2001 |

(Continued)

*Primary Examiner*—Emmanuel M Marcelo
(74) *Attorney, Agent, or Firm*—Ryan Kromholz & Manion, S.C.

(57) ABSTRACT

Provided is a tensioning clutch to be used in a tool for tensioning bundle, or cable, ties. A tensioning clutch according to the present invention includes a pawl mechanism having a removable pawl insert adapted to be reoriented or replaced without requiring significant disassembly of the housing of the tool. A tensioning clutch according to the present invention includes a pawl link, a tension abutment at least partly contemporaneously movable with the pawl link, and a pawl mechanism movably coupled to the pawl link. The pawl mechanism includes a pawl insert having one or more tie engagement surfaces, the insert being detachably coupled to a pawl body. The tie engagement surface of the insert may be biased towards, and movable away from, the tension abutment.

9 Claims, 3 Drawing Sheets

U.S. PATENT DOCUMENTS

| | | | | |
|---|---|---|---|---|
| 4,081,002 | A | | 3/1978 | Violi |
| 4,093,005 | A | | 6/1978 | Eberhardt et al. |
| 4,128,918 | A | | 12/1978 | Wenk |
| 4,129,157 | A | | 12/1978 | Sciolotto |
| RE29,973 | E | | 4/1979 | Paradis |
| 4,192,358 | A | | 3/1980 | Bone |
| 4,252,158 | A | | 2/1981 | McDade |
| 4,321,952 | A | * | 3/1982 | Natkins ..... 140/93.2 |
| RE30,996 | E | | 7/1982 | Pobuta et al. |
| 4,390,047 | A | | 6/1983 | Kaneko |
| 4,410,019 | A | | 10/1983 | Suzuki |
| 4,449,429 | A | | 5/1984 | Sauer et al. |
| 4,498,506 | A | | 2/1985 | Moody et al. |
| 4,499,928 | A | | 2/1985 | Furutsu |
| 4,548,242 | A | | 10/1985 | Paradis |
| 4,793,385 | A | | 12/1988 | Dyer et al. |
| 4,862,928 | A | | 9/1989 | Caveney et al. |
| 4,997,011 | A | | 3/1991 | Dyer et al. |
| 5,048,575 | A | | 9/1991 | Smith |
| 5,137,060 | A | | 8/1992 | Wolcott |
| 5,492,156 | A | | 2/1996 | Dyer et al. |
| 5,738,152 | A | | 4/1998 | Crittenden |
| 5,769,133 | A | | 6/1998 | Dyer et al. |
| 5,832,964 | A | | 11/1998 | Joshi |
| 5,915,425 | A | | 6/1999 | Nilsson et al. |
| 5,921,290 | A | | 7/1999 | Dyer et al. |
| D430,781 | S | | 9/2000 | Hillegonds |
| 6,206,053 | B1 | | 3/2001 | Hillegonds |
| D473,773 | S | | 4/2003 | Hillegonds |
| D491,430 | S | | 6/2004 | Magno, Jr. et al. |
| 6,840,289 | B2 | | 1/2005 | Hillegonds |
| D510,244 | S | | 10/2005 | Magno, Jr. et al. |
| 7,124,787 | B2 | | 10/2006 | Lueschen |
| 7,168,457 | B2 | | 1/2007 | Bernard |
| D543,811 | S | | 6/2007 | Lueschen |
| D547,626 | S | | 7/2007 | Lueschen |
| 2002/0020458 | A1 | | 2/2002 | Kuhn et al. |
| 2004/0079436 | A1 | | 4/2004 | Hillegonds |
| 2004/0177892 | A1 | | 9/2004 | Crittenden et al. |
| 2004/0187949 | A1 | | 9/2004 | Lenzen |
| 2005/0178459 | A1 | | 8/2005 | Magno, Jr. et al. |
| 2005/0178461 | A1 | | 8/2005 | Magno, Jr. et al. |
| 2005/0217749 | A1 | | 10/2005 | Magno, Jr. et al. |
| 2005/0268983 | A1 | | 12/2005 | Levin et al. |
| 2008/0035232 | A1 | | 2/2008 | Levin et al. |

FOREIGN PATENT DOCUMENTS

| | | | |
|---|---|---|---|
| EP | 1400448 | A1 | 3/2004 |
| EP | 1522495 | A1 | 4/2005 |
| EP | 1564144 | A2 | 8/2005 |
| EP | 1564145 | A1 | 8/2005 |
| WO | WO2005089978 | A1 | 9/2005 |

* cited by examiner

BUNDLE TIE TENSIONING CLUTCH

BACKGROUND OF THE INVENTION

The present invention relates generally to tools used in tensioning bundle ties and more specifically to a bundle tie tensioning clutch to be used in a bundle tie tensioning tool.

Flexible bundle ties are well known items. Such ties are used to secure wires, cables, tubing and similar items into tight, neat bundles. Typically, flexible bundle ties include a head portion and a tie tail portion extending from the head. In use, the tie tail is looped around the items to be secured and then inserted through the head. A locking or ratcheting mechanism in the head holds the tie tail in the head and secures the tie around the bundle. Preferably, the tie tail is pulled through the head under tension to draw the items to be secured into a tight bundle. Thereafter, the excess portion of the tie tail may be clipped off near the head.

Many flexible ties are economically molded of flexible plastic. For some applications, however, plastic has insufficient strength or other drawbacks, and metal ties are used. Metal ties include a flat strap portion and a locking head portion, each of which is made of a strong, durable metal such as stainless steel. As a rule, metal ties are significantly stronger than plastic ties of the same size and are typically pulled at much higher tensions than plastic ties when they are installed.

A variety of tools have been developed to enable workers to install flexible bundle ties with speed, uniformity and economy. Generally, such tools function to grip the tie tail portion of the tie after the tie has been looped around the items to be bundled. The tool pulls the tie tail until a predetermined desired tension is achieved, after which the tool cuts off the excess portion of the tie tail closely adjacent the head. Such tools greatly simplify the task of properly installing bundle ties.

In a typical tie tensioning tool, a tie is grasped and pulled by a tensioning clutch including a pawl, a pawl link, a shaft, a torsion spring, and tension abutment such as a backing plate. The tensioning clutch is generally slidably situated in a housing. The pawl link usually includes a yoke in which the pawl is rotatably supported on the shaft. The torsion spring includes a substantially stationary leg that cooperates with an aperture in the pawl link, and a biasing leg that cooperates with the pawl, thereby biasing the pawl toward the backing plate.

Various handheld tools have been developed to assist in the installation of flexible ties. In one well known form of such tool, the tool comprises a pistol or gun-like device having a movable trigger or lever that is squeezed by the operator to pull on the tie tail and thereby tension the tie. The operator continues squeezing the trigger until a predetermined tension is achieved after which a cutting blade adjacent the nose of the tool snaps upwardly to clip off the excess portion of the tie tail. A knob at the rear of the tool allows the worker to adjust or set the tension at which cutoff occurs. Examples of such manually operated handheld tools are shown in the inventors' U.S. Pat. No. 4,997,011, issued Mar. 5, 1991, U.S. Pat. No. 4,793,385 issued Dec. 27, 1998, and U.S. Pat. No. 5,921,290 issued Jul. 13, 1999, commonly owned by the assignee hereof.

The pawls of prior devices were normally cast in hardened steel and had teeth, which gripped a tie when the tie was inserted between the pawl and the cooperating tension abutment or backing plate. The pawl is a wear part of a tensioning tool. That is, eventually and frequently, the teeth on the pawl wear down and the clutch needs to be repaired or the pawl replaced. This is especially true when the tensioning tool is used with metal ties, such as stainless steel ties. Replacing or repairing a damaged or worn pawl is both time and labor intensive. Most prior devices require that the tool be taken out of service for repair, and replacement of the pawl requires disassembly of the tool's housing. As with any industrial teardown repair, care must be taken to ensure that reassembly is properly executed, and the tool must be tested prior to reinstatement of service.

Therefore, the art of tensioning bundle ties may benefit from a bundle tie tensioning clutch having an engagement surface that may be changed when desired, without significant disassembly of the remainder of the tensioning tool.

SUMMARY OF THE INVENTION

The present invention provides a bundle tie tensioning clutch having an engagement surface that may be changed when desired, without significant disassembly of the remainder of the tensioning tool.

In one embodiment, a tensioning clutch according to the present invention includes a pawl link, a tension abutment at least partly contemporaneously movable with said pawl link, and a pawl mechanism movably coupled to the pawl link. The pawl mechanism includes a pawl insert that is detachably coupled to a pawl body. The pawl insert includes a tie engagement surface, which is preferably biased towards and movable away from, the tension abutment, which may be a backing plate coupled to the pawl link. While the backing plate and pawl link could be provided separately, the backing plate may, instead, be formed integrally with the pawl link. The pawl mechanism is rotatably supported by the pawl link. The pawl link may form a yoke at least partially in which the pawl mechanism is movably supported. Such movable support may be provided in the form of rotatable support upon a bearing shaft.

The pawl insert is detachably coupled to said pawl body, which may be, for example, by a threaded mounting bolt inserted through said pawl insert and engaging a threaded mounting aperture located in the pawl body. In another embodiment, the pawl insert may be a polygonal insert having a plurality of tie engagement surfaces, such as three tie engagement surfaces. The pawl insert may be formed from, or at least include, a material including a carbide. The insert may include a tool surface, an access surface generally opposed from the tool surface by an insert thickness, at least one side surface extending from the access surface to the tool surface, and a mounting aperture accessible through the insert thickness. The insert tie engagement surface is preferably formed by the junction of the side surface and the access surface. The pawl body preferably includes an insert lip adapted to interface to at least one side surface of the pawl insert. The insert access surface may be a polygonal, planar surface, such as a triangular surface, for example. Similarly, the insert tool surface may be a polygonal, planar surface, such as a triangular surface.

The pawl mechanism of a tensioning clutch according to the invention may be biased towards the tension abutment by a torsion spring exerting a first force against said pawl link and a second force against the pawl mechanism. The second force may be exerted against the pawl body.

In another embodiment, an improvement is provided for a bundle tie tensioning tool having a mechanism for grasping a bundle tie. The improvement includes a pawl mechanism movably coupled to a pawl link. The pawl mechanism includes a pawl insert detachably coupled to a pawl body.

Furthermore, the pawl link may be adapted for substantially linear reciprocal sliding movement within a housing of the tool.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
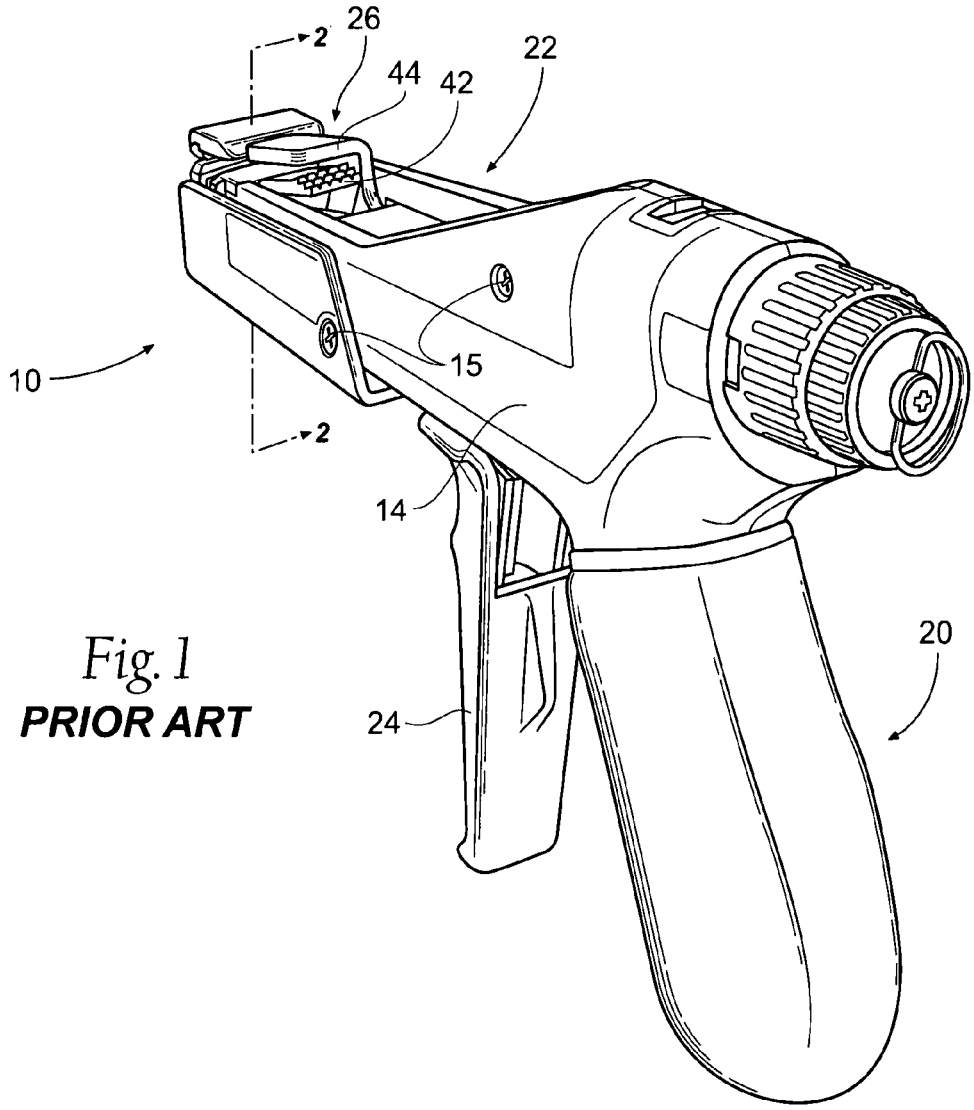
Fig. 1 PRIOR ART
FIG. 1 is a perspective view of a prior art cable tie tensioning apparatus.
Figure 2:
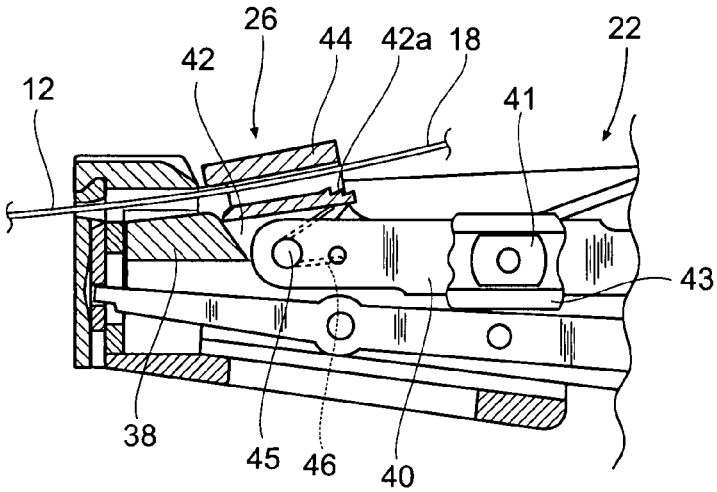
Fig. 2 PRIOR ART
FIG. 2 is a right elevation partial cross section view taken along line 2-2 of FIG. 1.

Turning now to the Figures, FIG. 1 and FIG. 2 show a prior bundle tie tensioning tool 10. The handheld tool 10 may be optimized for use with metal, and, in particular, stainless steel, ties. The handheld tool 10 includes a generally gun or pistol shaped housing 14 having a handle or grip portion 20, a barrel portion 22 and a trigger 24. The housing 14 is usually provided in a plurality of parts held together by threaded fasteners 15. The trigger 24 is located forwardly of the grip 20 and under the barrel portion 22 where it falls naturally under the fingers of the operator. The trigger 24 is movable from an initial position spaced away from the grip 20 to a second position nearer the grip 20.

A tie 12 is tensioned by means of a tensioning clutch 26, which is slidably disposed at least partially within the barrel portion 22 of the housing 14. The tensioning clutch 26 grips a tail portion 18 of the tie 12 and pulls it rearwardly as the trigger 24 is moved from the initial position to the second position. When the trigger 24 is released, it springs forwardly to the initial position. At the same time, the tensioning clutch 26 releases the tie tail 18 and moves forwardly relative to the tie tail 18. As the trigger 24 is once again squeezed, the tensioning clutch 26 once again grips the tie tail 18 and draws it rearwardly. The process is repeated until a desirable tension is achieved in the tie 12.

With reference more particularly to FIG. 2, the construction of the prior tensioning clutch 26 may be more fully explained. As illustrated, the tensioning clutch 26 is internally mounted at least partially in the barrel portion 22 and includes a pawl link 40 mounted for horizontal, linear reciprocating movement relative to the housing 14. The pawl link 40 may be supported for linear sliding movement within the housing 14 by means of slider blocks 41 received within rectangular-sectioned channels 43 formed on the interior wall of the housing 14. When a tie 12 is inserted into the tool 10, the tie tail 18 is gripped by means of a tie gripping pawl 42 carried upon a shaft 45 disposed towards the forward end of the pawl link 40. The gripping pawl 42 is pivotally attached to the pawl link 40 and is upwardly biased toward a tension abutment such as a backing plate 44, which is also carried by the pawl link 40. In the prior device 10, the backing plate 44 is integrally formed with the pawl link 40. The gripping pawl 42 is rotatably biased toward the backing plate 44 by means of a torsion spring 46 so that a bundle tie tail 18 inserted therebetween will be engaged by and between the pawl 42 and the backing plate 44. The upper surface of the pawl 42 is provided with teeth or serrations 42*a* that engage the tie tail 18.

A nose guide block 38 may be provided within the housing 14. The guide block 38 includes a surface that engages the gripping pawl 42 when the pawl link 40 is at the leftmost or initial position. Such engagement pivots the gripping pawl 42 away from the backing plate 44 to facilitate insertion of the tie tail 18 into the tool 10. When the pawl link 40 moves toward the right, the tie tail 18 is pinched between the gripping pawl 42 and the backing plate 44. The tie tail 18 is thus pulled along with the pawl link 40. It will be appreciated that, as the pawl links 40 move to the right, the gripping pawl 42 grips the tie tail 18 to pull the tie tail 18 and thereby tension the tie 12. When the pawl link 40 is reciprocated to the left, the gripping pawl 42 loosens its grip on the tie tail 18, thereby permitting the pawl link 40 to return to its initial position without simultaneously moving the tie tail 18.

Figure 3:
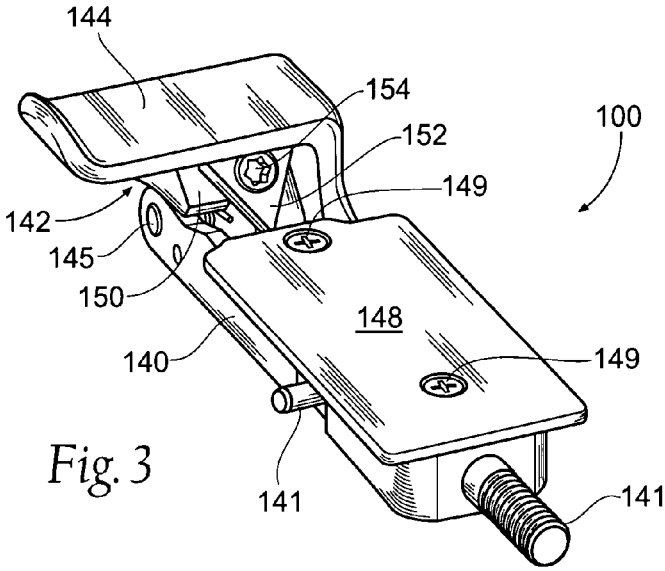
FIG. 3 is a perspective view of an embodiment of a tensioning clutch according to the present invention.
Figure 4:
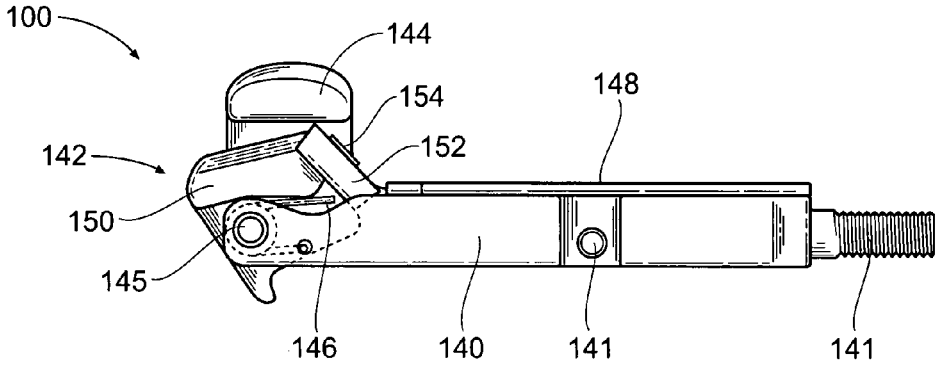
FIG. 4 is a right elevation view of the embodiment of FIG. 3.

Turning now to FIG. 3 and FIG. 4, an embodiment 100 of a bundle tie tensioning clutch according to the present invention is shown. Like prior devices, the tensioning clutch 100 includes a pawl link 140, a pawl mechanism 142, a tension abutment such as a backing plate 144, a shaft 145, and a torsion spring 146. The clutch 100 also preferably includes a tool interface 141 that may include mounting structure such as a threaded stud to be linked to the drive mechanism of the tool and bearing supports to provide a mounting location for slide blocks, similar to those 41 in FIG. 2. A tensioning clutch according to the present invention may be used with a variety of tensioning tools that may be actuated by, for example, mechanical means, pneumatic means, electromechanical means, electrical means, manual means, or any combination thereof. Further, the clutch 100 may include a transition plate 148 mounted to the pawl link 140 by a pair of threaded fasteners 149. As explained further below, the pawl mechanism 142 of a tensioning clutch 100 according to the present invention includes a replaceable pawl insert 152. The pawl insert 152 is mounted to the pawl body 150 in a manner that allows removal and replacement of the insert 152 without the need for disassembly of the entire tensioning tool.

Figure 5:
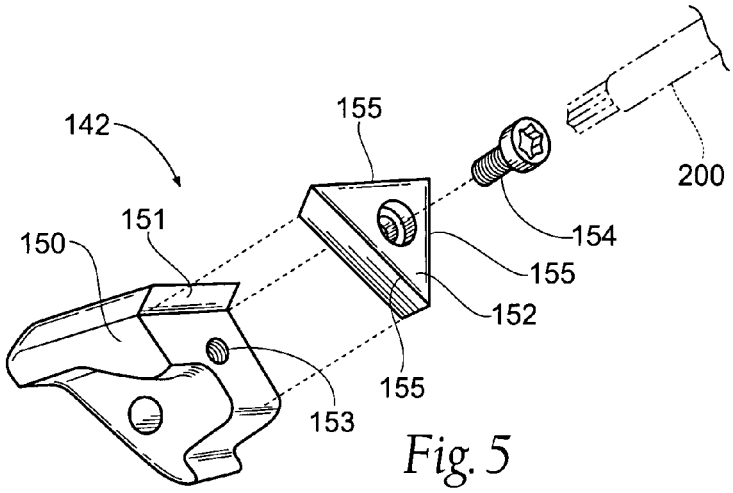
FIG. 5 is an assembly view of an embodiment of a pawl mechanism to be used in a tensioning clutch according to the present invention.

FIG. 5 provides an assembly view of an embodiment of a pawl mechanism 142 according to the present invention. The pawl mechanism 142 includes a pawl body 150 and a replaceable pawl insert 152, which is coupled to the pawl body 150 preferably by a threaded mounting bolt 154. If a threaded mounting bolt 154 is used, the mounting bolt 154 may be removed by using a tool, such as a manual screwdriver 200, for example. Such removal may occur preferably while the clutch 100 is operatively mounted in a tensioning tool. The pawl body 150 preferably includes structure to maintain the pawl insert 152 in a desired orientation. In this example, the pawl body 150 has an insert lip 151, against which a side of the pawl insert 152 rests when coupled to the body 150, and a threaded mounting aperture 153, adapted to accept the threaded mounting bolt 154. The pawl body 150 is preferably formed from any desirable supportive material, such as steel, aluminum, etc. The pawl insert 152 is preferably a commercially available triangular carbide insert such as a G10E insert available from Sumitomo Electric Carbide, Inc. of Mount Prospect, Ill. The insert 152 has preferably a plurality of tie engagement surfaces 155. While a triangular insert 152 is preferred, any polygonal insert 152, such as a rectangle, a pentagon, a hexagon, etc., may also be used. Use of a polygonal insert 152 having multiple engagement surfaces 155 provides a user the ability to quickly adjust the insert 152, thereby providing a sharp edge when one is desired. Inserts 152 having different shapes than those listed may also be employed.

Figure 6:
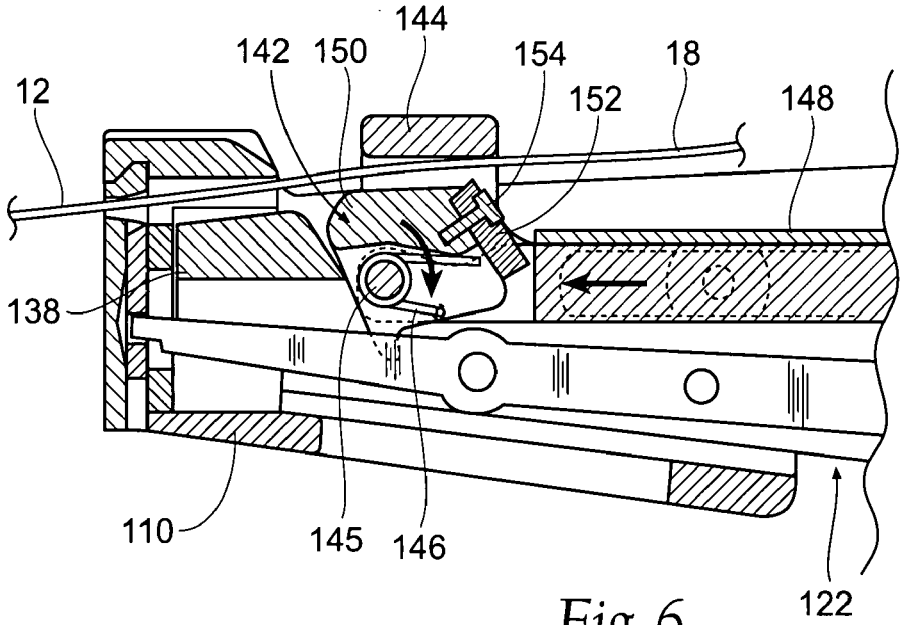
FIG. 6 is a right elevation partial cross section of a tool incorporating the tensioning clutch embodiment of FIG. 3 in a first position.

FIG. 6 shows the embodiment 100 of FIG. 3 that has been incorporated into the barrel portion 122 of a bundle tie tensioning tool 110 similar to the prior tool 10 of FIG. 1. In this position, the pawl mechanism 142 is rotated rearwardly by the nose guide block 138, thus parting the pawl insert 152 from the backing plate 144 to ease lateral tie insertion.

Figure 7:
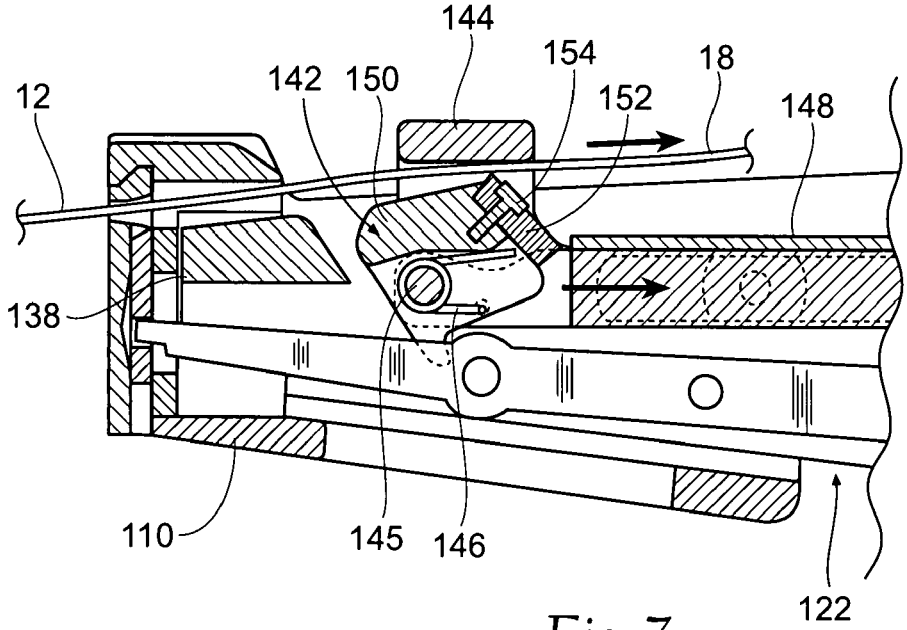
FIG. 7 is a right elevation partial cross section of a tool incorporating the tensioning clutch embodiment of FIG. 3 in a second position.

FIG. 7 also shows the embodiment 100 of FIG. 3 that has been incorporated into the barrel portion 122 of a bundle tie tensioning tool 110 similar to the prior tool 10 of FIG. 1; however, the tensioning function of the tool has been activated, e.g. by way of a user grasping a trigger on the tool 110, so that the clutch 100 has been retracted away from the nose guide block 138 thereby allowing the torsion spring 146 to bias a tie engagement surface 155 of the pawl mechanism 142 against the tie 12. The tie 12 is thus gripped between the pawl insert 152 and the backing plate 144 during a majority of the retraction of the clutch 100.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

We claim:

1. A tensioning clutch comprising:

a pawl link;

a tension abutment at least partly contemporaneously movable with said pawl link;

a pawl mechanism movably coupled to said pawl link, said pawl mechanism including a pawl insert detachably coupled to a pawl body, said pawl insert including a tie engagement surface;

said tie engagement surface being biased towards, and movable away from, said tension abutment;

said pawl link forming a yoke at least partially in which said pawl mechanism is movably supported and said pawl mechanism being rotatably supported upon a bearing shaft.

2. A tensioning clutch comprising:

a pawl link;

a tension abutment at least partly contemporaneously movable with said pawl link;

a pawl mechanism movably coupled to said pawl link, said pawl mechanism including a pawl insert detachably coupled to a pawl body, said pawl insert including a tie engagement surface;

said tie engagement surface being biased towards, and movable away from, said tension abutment;

said pawl insert being detachably coupled to said pawl body by a threaded mounting bolt inserted through said pawl insert and engaging a threaded mounting aperture located in said pawl body.

3. A tensioning clutch comprising:

a pawl link;

a tension abutment at least partly contemporaneously movable with said pawl link;

a pawl mechanism movably coupled to said pawl link, said pawl mechanism including a pawl insert detachably coupled to a pawl body, said pawl insert including a tie engagement surface;

said tie engagement surface being biased towards, and movable away from, said tension abutment;

said pawl mechanism being biased towards said tension abutment by a torsion spring exerting a first force against said pawl link and a second force against said pawl mechanism;

said second force being exerted against said pawl body.

4. A tensioning clutch comprising:

a pawl link;

a tension abutment at least partly contemporaneously movable with said pawl link;

a pawl mechanism movably coupled to said pawl link, said pawl mechanism including a pawl insert detachably coupled to a pawl body, said pawl insert including a tie engagement surface;

said tie engagement surface being biased towards, and movable away from, said tension abutment;

said pawl insert including:

a tool surface;

an access surface generally opposed from said tool surface by an insert thickness;

at least one side surface extending from said access surface to said tool surface; and a mounting aperture accessible through said insert thickness, said tie engagement surface being formed by the junction of said side surface and said access surface.

5. A tensioning clutch according to claim 4, said pawl body including an insert lip adapted to interface to at least one side surface of said pawl insert.

6. A tensioning clutch according to claim 4 wherein said insert access surface comprises a polygonal, planar surface.

7. A tensioning clutch according to claim 6 wherein said insert access surface is triangular.

8. A tensioning clutch according to claim 4 wherein said insert tool surface comprises a polygonal, planar surface.

9. A tensioning clutch according to claim 8 wherein said insert tool surface is triangular.

* * * * *